US010094171B2

(12) United States Patent
Kočiš et al.

(10) Patent No.: US 10,094,171 B2
(45) Date of Patent: Oct. 9, 2018

(54) GENERATING ELECTRIC ARC, WHICH DIRECTLY AREALLY THERMALLY AND MECHANICALLY ACTS ON MATERIAL, AND DEVICE FOR GENERATING ELECTRIC ARC

(71) Applicant: GA DRILLING, A.S., Trnava (SK)

(72) Inventors: Ivan Kočiš, Bratislava (SK); Gabriel Horváth, Dunajská Streda (SK); Lukáš Dvonč, Partizánske (SK)

(73) Assignee: GA DRILLING, A.S., Trnava (SK)

( * ) Notice: Subject to any disclaimer, the term of this patent is extended or adjusted under 35 U.S.C. 154(b) by 417 days.

(21) Appl. No.: 14/773,178

(22) PCT Filed: Mar. 4, 2014

(86) PCT No.: PCT/SK2014/050006
§ 371 (c)(1),
(2) Date: Sep. 4, 2015

(87) PCT Pub. No.: WO2014/137299
PCT Pub. Date: Sep. 12, 2014

(65) Prior Publication Data

US 2016/0024849 A1 Jan. 28, 2016

(30) Foreign Application Priority Data

Mar. 5, 2013 (SK) ..... 50006-2013

(51) Int. Cl.
*E21B 7/15* (2006.01)
*H05H 1/40* (2006.01)
*H05H 1/50* (2006.01)

(52) U.S. Cl.
CPC ..... *E21B 7/15* (2013.01); *H05H 1/40* (2013.01); *H05H 1/50* (2013.01)

(58) Field of Classification Search
CPC .... E21B 7/00; E21B 7/14; E21B 7/15; H05H 1/40; H05H 1/50
See application file for complete search history.

(56) References Cited

U.S. PATENT DOCUMENTS 1,898,926 A 2/1933 Aarts et al.
2,868,950 A 1/1959 Gage
(Continued)

FOREIGN PATENT DOCUMENTS

DE 10 2011 053 106 A1 8/2012

OTHER PUBLICATIONS

Zhukov, M.F. and Zasypkin, I.M., Ed. "Thermal Plasma Torches Design, Characteristics, Applications", Cambridge International Science Publishing, Cambridge, UK Jan. 2007 (610 pages).
(Continued)

*Primary Examiner* — Yong-Suk Ro
(74) *Attorney, Agent, or Firm* — Hovey Williams LLP; Joan Optican Herman

(57) ABSTRACT

A generating electric arc is disclosed herein, which thermally and mechanically acts on a material in such a manner that the electrical arc is shaped and guided by the action of a magnetic field and hydro-mechanical forces on the electrical arc. Generally, a substantial part of the electric arc acts directly and areally on a conductive and/or non-conductive material to be disrupted, a substantial part of the electric arc's heat flow is directed into the material to be disrupted, both electric arc roots move on the electrodes of a generator, and the electric arc has preferably a shape of a spiral.
A device is also provided herein for generating an electric arc with thermal and mechanic action on a material containing axially symmetrical electrodes, i.e. an anode (4) and a cathode (6), a spark gap (7), nozzles (5) for the working medium flow, cooling media inlet and outlet (12), electric
(Continued)

power supply (14), and ring-shaped magnets (9) whose section has the shape of a triangle. Typically, the anode (4) has the shape of the diffuser with an angular span from 5° to 130°.

18 Claims, 3 Drawing Sheets

(56) References Cited

U.S. PATENT DOCUMENTS

| | | | | |
|---|---|---|---|---|
| 2,979,449 | A | 4/1961 | Sheer et al. | |
| 3,082,314 | A | 3/1963 | Arata et al. | |
| 3,396,806 | A | 8/1968 | Benson | |
| 3,453,488 | A * | 7/1969 | Harder | H05H 1/40 313/161 |
| 3,467,206 | A | 9/1969 | Acheson et al. | |
| 3,693,731 | A | 9/1972 | Armstrong et al. | |
| 3,944,778 | A | 3/1976 | Bykhovsky et al. | |
| 4,055,741 | A | 10/1977 | Bykhovsky et al. | |
| 4,391,339 | A | 7/1983 | Johnson, Jr. et al. | |
| 4,626,648 | A * | 12/1986 | Browning | H05H 1/34 219/121.5 |
| 5,148,874 | A | 9/1992 | Foppe | |
| 5,220,150 | A * | 6/1993 | Pfender | H05H 1/341 219/121.48 |
| 5,244,488 | A | 9/1993 | Sato et al. | |
| 5,479,994 | A | 1/1996 | Soloviev et al. | |
| 5,771,984 | A | 6/1998 | Potter et al. | |
| 5,801,489 | A | 9/1998 | Chism, Jr. et al. | |
| 6,744,006 | B2 | 6/2004 | Johnson et al. | |
| 7,727,460 | B2 | 6/2010 | Deegan et al. | |
| 7,784,563 | B2 | 8/2010 | Rodland et al. | |
| 2002/0134766 | A1* | 9/2002 | Kawachi | B22D 11/11 219/121.36 |
| 2007/0193518 | A1* | 8/2007 | Shiina | C23C 14/325 118/723 R |
| 2009/0294273 | A1* | 12/2009 | Monsen | B01J 19/088 204/156 |

OTHER PUBLICATIONS

Munz et al., "Application of transferred arcs to the production of nanoparticles", Pure Appl. Chem., vol. 71, No. 10, pp. 1889-1897, 1999, copyright 1999 IUPAC (9 pages).
Bulgakova et al., "Pulsed laser ablation of solids: transition from normal vaporization to phase explosion", Appl. Phys. A, 2001, vol. 73, p. 199-208 (10 pages).
Woskov et al., "Annual Report 2009 Millimeter Wave Deep Drilling for Geothermal Energy, Natural Gas and Oil", Sep. 2009, Plasma Science and Fusion Center, Massachusettes Institute of Technology, Cambridge, MA 02139 (8 pages).
Bluhm et al., "Application of Pulsed HV Discharges to Material Fragmentation and Recycling", IEEE Transactions on Dielectrics and Electrical Insulation, vol. 7, No. 5, Oct. 2000, pp. 626-636 (Abstract only, 1 page).
Yutkin, L.A., Elektrogidravliceskij efekt. Mashinostrojenie—Leningradskoe otdelenie, Leningrad, ISBN 3806811601 (1986) (article unavailable).
Dubovenko et al., "Underwater electrical discharge characteristics at high values of initial pressure and temperature", IEEE International Conference on Plasma Science 1998 (Abstract only, 1 page).
Hasebe et al., "Focusing of Shock Wave by Underwater Discharge, on Nonlinear Reflection and Focusing Effect", Zairyo (Journal of the Society of Materials Science, Japan), vol. 45, No. 10, Oct. 15, 1996, pp. 1151-1156 (6 pages).
Weise et al., "Experimental investigations on rock fractioning by replacing explosives with electrically generated pressure pulses", IEEE International Pulsed Power Conference—Digest of Technical papers vol. 1, 1993 (1st page only, 1 page).
Von Neumann et al., "A Method for the Numerical Calculation of Hydrodynamic Shocks", Journal of Appl. Physics 21, 232-237, 1950 (18 pages).
Gerdien et al., "A very high intensity are discharge (suitable also for nitrogen fixation)", Wiss. Veroffentl. Siemens-Konzem (1992), 2, 489-96 (Abstract only, 1 page).
Maecker, "Luminous arc for high output", Zeitschrift fuer Physik (1951), 129, 108-22 CODEN; ISSN: 0044-3328 (Abstract only, 1 page).
Michajlov, Perspektivy prakticeskovo ispolzovanja elektrodugovoj, vodno-parnoj plazmy. Teplofyzika i airodinamika, vol. 9, Issue 1, Department of Theoretical and Applied Mechanics SORAN., Novosibirsk, 2002, UDK. 537.523.5 (Article not available).
Gilland et al., "Magnetic Nozzle Studies for Fusion Propulsion Appliations: Gigawatt Plasma Source Operation and Magnetic Nozzle Analysis", Close Out and Final Report for NASA Glenn Cooperative Agreement NAG3-2601, NASA Glenn Research Center, Cleveland, Ohio, Jan. 1, 2004 (39 pages).
Jedlicka, "The Shape of a Magnetically Rotated Electric Arc Column in an Annular Gap", NASA Technical Note TN D-2155, Ames Research Center, Moffett Field, California, Oct. 1964 (40 pages, best copy available).
Hrabovsky et al, IEEE Trans. on Plasma Science 3, 1993 (not available).
Ito, Yukikazu et al., "Low-Temperature Sintering of Indium Tin Oxide Thin Film Using Split Gliding Arc Plasma," Japanese Journal of Applied Physics, Part 1. vol. 47, No. 8, Aug. 2008 pp. 6956-6959 (4 pages).
Gangoli S.P., et al., "A non-equilibrium plasma source: magnetically stabilized gliding arc discharge: I. Design and diagnostics," Plasma Sources Science and Technology, Institute of Physics Publishing, Bristol, GB, vol. 19, No. 6, Dec. 1, 2010 (065003) (7 pages).
Fridman, Alexander et al., "Characteristics of Gloding Arc and Its Application in Combustion Enhancement," Journal of Propulsion and Power, vol. 24, No. 6, Nov. 2008 pp. 1216-1228 (13 pages).
Ombrello, Timothy et al., "Kinetic Ignition Enhancement of Diffusion Flames by Nonequilibrium Magnetic Gliding Arc Plasma," AIAA Journal, vol. 46, No. 10, Oct. 2000 pp. 2424-2433 (10 pages).
International Search Report and Written Opinion in corresponding PCT/SK2014/050006 dated Jul. 30, 2014 (12 pages).

* cited by examiner

GENERATING ELECTRIC ARC, WHICH DIRECTLY AREALLY THERMALLY AND MECHANICALLY ACTS ON MATERIAL, AND DEVICE FOR GENERATING ELECTRIC ARC

RELATED APPLICATIONS

This application is the National Stage of International Patent Application No. PCT/SK2014/050006, filed Mar. 4, 2014, which is hereby incorporated by reference in its entirety, and which claims priority to Slovakian application No. PP50006-2013, filed Mar. 5, 2013.

TECHNICAL FIELD

The invention concerns generating an electric arc which acts directly areally thermally and mechanically on the material and the device for generating the electric arc, intended for use mainly in material disintegration and drilling in geological formations.

THE STATE OF ART

The thermal plasma generators have been known since the 40s in their non-transferred as well as transferred arc form (melting furnaces in metallurgy). State of the art is comprehensively treated in the monograph Thermal plasma torches Design, Characteristics, Applications edited by M. F. Zukov and I. M. Zasypkin with extensive theoretical background.

Thermal, action of an electric arc on the material can be divided into four categories:

1. Indirect action through plasma gas which is heated by an electric arc where both arc roots are inside the non-transferred arc device (conventional plasmatrons).
2. Systems where one arc root is inside the device and the second arc root is on the conductive object of action (commercial transferred arc systems—plasma cutting, welding, etc.).
3. Direct action systems where both electric arc roots on the electrodes as well as the actual arc are transferred near the object of action (Some arc furnaces and drilling equipment Aarts et al.).
4. Direct action systems where both roots of an electric arc on the electrodes are not transferred and inside the device and the arc itself (its greater part) is transferred near the object of action (the present invention).

Plasmatrons with non-transferred arc generate heat flow in the plasma (torch) with temperatures about 5-6000 K.

The transferred arc reaches temperatures up to 15-20 thousand K, at high pressure (up to 1000 bar) 50-60 thousand K, with a significantly higher radiating (radiation) performance.

Heat treatment of materials by an electric arc has a long history, from the mid-19th century, when this phenomenon was discovered. The possibility of generating high temperatures of up to several-fold 10 thousand ° K has been examined.

The use of transferred electric arc spread to the field of welding and cutting, which also involve intense material melting and its partial vaporization. All of these methods use the processed material as one of the electrodes. Significant innovations since occurs in this area since the first half of the 20th century. Common shortcoming is the use of welding or cutting material/metal/as one of the electrodes.

The first application of plasma was melting metal in electric arc furnaces, which represented a revolutionary change compared to hydrocarbon fuel furnaces.

One of the patents utilizing transferred arc in this field was U.S. Pat. No. 5,244,488 Ryoda et al., the first one not using the melt as one of the electrodes, but instead three electrodes between which the arc process take place. A similar principle exploits the method disclosed in U.S. Pat. No. 2,979,449: Carbothermic reduction of metal oxides by Sheer C. et al., which uses temperatures up to 10 000 K for vaporization of materials and their subsequent condensation to obtain pure metal.

Similarly, the implementation method for the plasma reactor in the U.S. Pat. No. 7,727,460 uses two electrodes, independent of the processed material, to implement the transferred arc that vaporizes the material.

In the fifties, the first applications of thermal plasma generators gradually emerged, particularly in plasma cutting, welding and plasma plating of metal and ceramic layers.

The patents U.S. Pat. No. 2,868,950: Electric Metal Arc process and apparatus by Gage, R. M., and further U.S. Pat. No. 3,082,314: Plasma arc torch by Arata, Y. A. et al. and U.S. Pat. No. 4,055,741: Plasma arc torch by Bykhovsky et al. disclose the plasma vortex generators. Their common drawback is that the torch temperature is limited to relatively low temperatures of about 6000 K to 8000 K.

Acme of the use of employing plasma generators for heat treatment of materials is the concept of coupled generators/twin plasma torch/, which is disclosed in U.S. Pat. No. 6,744,006: Twin plasma torch apparatus by Johnson T. P. et al. Its advantage is the electrical independence from the processed material. The drawback is the need to use two full-value plasmatrons and the transferred arc can be only in the shape of a line segment.

The closest in nature to the present patent is material vaporization by a transferred arc in order to create micro or nano particles.

In the article Application of transferred arcs to the production of nanoparticles, the authors Munz R. J., Addon T., da Cruz A. C., an overview of the electric arc uses to produce nanoparticles by vaporization of the parent material is presented. In the PhD. thesis of Adonn T: Experimental and modelling study of the plasma vapour synthesis of ultrafine AlN powders. Mc Gill University, Montreal, 1998.

Described systems share one common feature, which is also their drawback, that is the evaporated material forms the material of the anode consumed, where one of the transferred arc roots is located.

Regarding physics of material vaporization process, there are solutions for vaporization by high-power laser beam (MW up to TW) but lasting only a fractions of microseconds or up to nanosecond, rarely femtosecond. These principles are not practically applicable for drilling processes but are a good theoretical reference for theoretical works in the field of the processes of vaporization, agglomeration, condensation, clustering, as well as processes of shielding the energy flow from transferred arc by evaporated rock.

As a part of the research of high-performance radars and accelerators in particle physics research, sources of powerful current pulses with instantaneous power in the range of MW up to GW have been developed.

The principal value of innovation in such power sources lies in time transforming of the power storage (set of capacitors or inductances) charging process. Charging takes time several orders longer than discharging the energy stored. For example, charging for one second by 1 kW source and discharging of the stored energy for 1 millisecond leads to electric discharge with instantaneous power of 1 MW. Discharging during shorter time interval, for example 1 microsecond, allows to focus the energy into instantaneous power of 1 GW.

This principle can be used also for generating high power by electro-hydraulic phenomenon or when generating electromagnetic fields of high intensity. Existing conventional plasmatrons do not allow for the use of such extreme power outputs.

In an article by N. M. Bulgakov and A. V. Bulgakov Pulsed laser ablation of solids: Transition from normal vaporization to phase explosion.—Appl. Phys. A, 2001, Vol. 73, pages 199-208 the authors disclose fast and explosive material vaporization under the effects of intense heat flow from the laser beam.

Using laser vaporization, however, has one major drawback. The laser beam is essentially a point source of heat and to cover the whole area of the borehole it is necessary to blur the beam, which significantly decreases its power density (W/m2), or to scan the beam across the whole surface with, and thereby decrease the power supplied per unit area by 2-3 orders. Similarly important reference source is the use of milimeter electromagnetic waves to melt or vaporize the rocks for purposes of drilling, disclosed in the article: "(1) Annual Report 2009, Millimeter Wave Deep Drilling For Geothermal Energy, Natural Gas and Oil MITEI Seed Fund Program, Paul Woskov and Daniel Cohn, MIT Plasma Science and Fusion Center 167 Albany Street, NW16-110, Cambridge, Mass. 02139.

Electro-hydraulic phenomenon, based on electrical discharge in an aqueous medium with the subsequent pressure shock wave, acts with an extreme pressure action on close objects. Applications of this phenomenon in rock breaking or, respectively, forming sheet metal as alternatives to hydraulic pressing process are known. Electro-hydraulic phenomenon has high efficiency in an aquatic environment and its effectiveness decreases in gas environment for the reason of differences in viscosity of environments on the order of magnitude. Conventional plasmatrons do not allow for utilization of this phenomenon.

Electro-hydraulic phenomenon disclosed by L. Yutkin in 1955 in his work "(Yutkin, L. A. (1986). Elektrogidrabliceskij efekt. Masinostrojenie—Leningradskoe otdelenie, Leningrad 3806811601; Bluhm, H. et al., "Application of Pulsed HV Discharges to Material Fragmentation and Recycling", IEEE Transactions on Dielectrics and Electrical Insulation, vol. 7, No. 5 Oct. 2000, 625-636; Dubovenko, K. V. et al., "Underwater electrical discharge characteristics at high values of initial pressure and temperature", IEEE International Conference on Plasma Science 1998; Hasebe, T. et al., "Focusing of Shock Wave by Underwater Discharge, on Nonlinear Reflection and Focusing Effect", Zairyo (Journal of the Society of Materials Science, Japan), vol. 45. No. 10 Oct. 15, 1996, 1151-1156; Weise, Th.H. G. G. et. al., "Experimental investigations on rock fractioning by replacing explosives with electrically generated pressure pulses", IEEE International Pulsed Power Conference—Digest of Technical papers v 1 1993.) discloses the use of thermal effect within the cross-section of spark discharges or an arc in the water, subsequent heat explosion and generation of pressure shock wave that fragments or deforms material in its vicinity.

Similar effects and shock wave processes were disclosed by J. von Neumann and R. D. Richtmyer in "A method for the numerical calculation of hydrodynamic shock" J. of Appl. Physics 21, 232-237 (1950).

The patent literature discloses a classic thermal plasma generator (plasmatron) in pat. U.S. Pat. No. 3,944,778 "Electrode assembly of plasmatron", by Bykhnovsky from 1976, in which the solution already contains basic principles of today's plasmatrons, including a pair of plasmatrons with transferred electric arc in between. Beginning the era of the most advanced plasmatrons represents U.S. Pat. No. 5,801,489 by Ruttberg et al. It is the first three-phase high-performance plasma torch using Lorentz forces to move arcs alongside the electrodes.

A special category of thermal plasma are plasmatrons, where the plasma gas is a water vapour, in certain cases even water that turns to steam in the device. The first experiments with an electric arc and water were done by H. Gerdien, A. Lotz Wiss. Veroffentlichungen Siemenswerk 2, 489, 1922, and later H. Maecker. Zeitschrift fuer Physik 129, 108-122, 1951 and particularly Hrabovsky et al., IEEE Trans. on Plasma Science 3, 1993.

Significant results were achieved by Hrabovský et al. researching the water plasma generator, where rotating water surface represents at the same time a container and an evaporator for production of steam, which is the plasma medium. Much higher specific heat of water compared to that of gases used gives a good foundation for the development of efficient thermal plasma generators with water vapour being the plasma gas as an environmentally friendly technology.

The issue was substantially treated in terms of heat recuperation and electrode life time by B. I. Michajlov: Perspektivy praktičeskovo ispolzovanja elektrodugovoj vodno-parnoj plazmy. Teplofyzika i airodinamika, Volume 9, Issue 1, Department of Theoretical and Applied Mechanics SORAN., Novosibirsk, 2002, UDK. 537.523.5.

The application of large heat flow generated by plasmatron in the form of "post glowing" plasma torch for the purposes of rock disintegration, among other things, is hampered by the problem of hot plasma layering above the material and therefore less efficient heat transfer into the material to be disrupted. Plasma flow is superimposed on the previous layers having similar temperatures, thereby hindering the intense heat transfer into the rock. This phenomenon is essentially identical whether using large monolithic plasma current or several smaller plasmatrons.

Using an arc for directly heating the material especially for drilling in rock was first patented by Aarts et al.: Electric arc drill in 1933. Shortcomings of this solution are that the electric arc is shaped as a line segment and unresolved stabilization of the arc and consumed electrodes.

In 1949 McCulloch had patented a device for drilling in rock with transferred arc and a single root on the rock. Shortcoming of this solution was impossibility of controlling the fluctuating electric arc. The greatest drawback, however, was the fact that most of the rock is non-conductive and even after heating the rocks show considerable fluctuations in conductivity.

In 1948 Verte had patented system with one central electrode, the other one being a cover heated by electric arc. This concept has been improved by Brichkin and Bolotov where the central electrode could slide and compensate for consumed length of the electrode. Karlovitz in 1961 patented a drilling device on the plasma basis, i.e. a gas heated by electric arc as the heat transfer mediator. This device, however, did not reach the required parameters and could not drill in limestone rocks. The device showed satisfactory properties in spallation mode.

Systems increasing the effects of material to be disrupted that can be used in the device according to the invention. In 1981 a cavitation drilling system, resp. material disintegrating system was patented by Johson Virgil E. et al.: Cavitating liquid jet assisted drill bit and method for deep-hole drilling, based on the mechanical principle of bubbles created by negative pressure, which when collapsing generate high pressure jets in the direction of rock to be disrupted.

Work on the use of thermal plasma in rock disintegration has been performed already in the sixties of the last century. None of those solutions, however, has entered into practice for various reasons. With hindsight, it appears that the reason is low overall efficiency of transport processes and heat transfer into the rock. The second problem is that they operate in an air environment, which is the cause of instability of the drill hole at greater depths and low efficiency of transporting disintegrated rocks to the surface.

Around the same period attempts appeared to use indirect action of heat on the rock through the heated body—the penetrator. Various ways of heating have been tried, for example electric heating, fuel and oxidant combustion and even using a small nuclear reactor has been proposed.

One of the first patents in this category, U.S. Pat. No. 3,396,806 by Benson et al. "Thermal underground penetrator", discloses all the essential features of such devices, but no practical verification is known.

The U.S. Pat. No. 3,693,731 "Method and apparatus for tunneling by melting" by Armstrong et al. from research laboratories at Los Alamos reached the practical verification in laboratory conditions. In addition to indirect heating it also employs borehole wall melting as a continuous drill hole casing. Practical energy efficiency has proven to be very low.

Continuation of this concept is the work disclosed in U.S. Pat. No. 5,148,874 "High-pressure pipe string for continuous fusion drilling of deep wells, process and device for assembling, propelling and dismantling it" by Foppe. The weakness of this concept is the solution for the elimination of molten rocks by injecting them into cracks in the surrounding rock, which proved unrealistic.

Promising innovative technology is drilling based on high-voltage discharge below the surface of the rock. The technology originated in the sixties at the University of Tomsk (Russian Federation). This work continued at the University of Strathclyde (UK) and was completed in U.S. Pat. No. 7,784,563 "Method, drilling machine, drill bit and bottom hole assembly for drilling by electrical discharge by electrical discharge pulses" by Rodland et al. with participation of the original authors from Tomsk.

The source described in U.S. Pat. No. 3,467,206, "Plasma drilling" by Acheson W. P. et al. which discloses the basic principles of drilling using single electric torch with a radial orientation.

Drilling through hydrothermal flame using chemical plasma and thermal spallation by influence of uneven rock expansion rates is disclosed in U.S. Pat. No. 5,771,984: "Continuous drilling of vertical boreholes by thermal processes: including rock spallation and fusion" by Potter et al.

Magnetic Nozzle Studies for Studies for Fusion Propulsion Applications Gigawatt Plasma Source Operation and Magnetic Nozzle Analysis by James H. Gilland et al. grant NASA Glenn Cooperative Agreement NAG 3-2601 Final Report.

The study discloses the creation of magnetic nozzle for plasma stream with power in Gigawatt and supersonic speeds. The research used cumulative source with a single pulse of 1.6 MJ to generate large currents up to 3.10 exp5 A. The magnetic nozzle concept has been successfully applied in demanding aerospace applications.

The work: NASA Technical Note TN D-2155 Ames Research Center, NASA Moffet Field "The shape of magnetically rotated electric arc column in an annular gap" by Jedlička R. James for the first time disclosed solution based on the rotation of electric arc in a spiral (evolvent of the circle), using concentric cylindrical electrodes along whose surface the arc roots rotate, between which is the arc's path in form of a spiral. This solution forms the heat source shape with necessary properties of homogeneity and sufficient surface cover for heat flow generation. This work also presents replacement of the arc model with a cylindrical solid body, to be used in simulation modelling of the arc movement in a viscous environment.

Sweep movement of arc roots on the circular electrode surface contributes significantly to lengthening their life.

Electric field between the electrodes is an insignificant component of the forces acting on the arc when compared to the forces induced by an external magnetic field.

U.S. Pat. No. 5,479,994 "Method of electrothermomechanical drilling and device for its implementation" by Soloviev G. N. et al. discloses a two-phase technology based on primary drying of the rock (dehydration) under 750-950 K, the following mechanical action and the third step of heating up to 1800-2300 K. This method, however, has not entered into practice for its large energy demands. The disadvantage is therefore high energy demand.

U.S. Pat. No. 7,784,563 "Method, drilling machine, drill bit and bottom hole assembly for drilling by electrical discharge by electrical discharge pulses" by Rodland A. et al. discloses a solution based on the theory of electrical discharge in the water from eighties, combined with water streams to wash initial rock fragments and subsequent mechanical disintegration. The technology itself is not applicable for drilling machines because rock pre-treatment produces rock fragments of uncontrolled dimensions which consequently must be mechanically processed. Described processes, however, have not been applied by direct action of an electric arc to the rock.

The above mentioned disadvantages are eliminated by the present patent which is a starting point into the use of large-scale transferred arcs for the purpose of disintegrating materials and drilling in geological formations.

Use of electric thermal plasma for the purposes of drilling into rock has two sources: one in the former USSR—Plazmobury. None of the described patents achieved overall efficiency of heat transfer into the rock that would be economically advantageous.

The present solution focuses mainly on improving the transfer efficiency from electric power up to transfer of heat energy into the rock.

Nature of the Invention

The properties of electric arc have not yet been employed in direct areal material disintegration in close proximity to the electric arc. The present invention eliminates the deficiencies and disadvantages of the processes described in the prior art and is the basis to the use of transferred electric arcs for the purposes of drilling in geological formations.

Transferred electrical arc creates a homogeneous heat flow and acts directly on the material so that at least part of the electric arc is pressed by action of forces against the surface of the material to be disrupted. The electric arc is produced in a spark gap and formed into the desired shape between the electrodes of the diffuser.

The direct action of an electric arc means action with minimizing intermediating plasma medium, which provides the heat transfer between arc and the material to be disrupted. Plasma medium is contained in the working medium which is fed into the device to fulfil following purposes: cooling the device, acting with force on the electric arc and being the source of plasma medium necessary for arc burning. In conventional plasma generators, energy in the electric arc passes into the medium which itself acts on the material to be disrupted. Solution according to the present invention lies in taking and shaping the arc and its direct action on the material to be disrupted. In order to make such disintegration by direct areal electric arc possible, it is necessary during the whole process to constantly shape and press down the electric arc near to the material and remove material to be disrupted and excess gases from the working area so as to allow direct contact between the electric arc and material to be disrupted.

The electric arc generated between the electrodes in a spark gap of the device for generating an electrical arc is shaped and guided by the action of magnetic field and hydro-mechanical forces in such manner that:

- the substantial part of the electric arc acts directly and areally on conductive and/or non-conductive material to be disrupted,
- the substantial part of the electric arc's heat flow is directed into the material to be disrupted,
- both electric arc roots move on the electrodes of the generating device.

It is preferred that the electric arc is formed and guided in such manner that a substantial part of the electric arc is pushed out and moving outside the space of the generator.

Part of the conducting electric arc channel is by shaping and guiding placed near the surface of material to be disrupted. This part of the conductive channel is in a moving state. It is preferred that at least part of the transferred electric arc is shaped such that at least part the conductive channel of the electric arc has the shape of a spiral which rotates in a specified disc-shaped space, and is movable in an axial direction. The conductive channel's spiral shape is formed by the action of magnetic forces and/or fluid flow forces.

Hydro-mechanical forces are created by the interaction of smoothly expanding working medium with an electric arc and by their action guide the electric arc.

To increase the life of electrodes it is preferred that the magnetic fields and hydrodynamic forces acting on the electric arc, and also the electrode geometry, preferably interact in such manner that they increase the heat-exposed surface of the electrodes on which the roots of the electric arc move.

It is preferred that the electrode has the shape of the diffuser, because this shape increases the area through which working medium flows.

Magnetic field and hydrodynamic forces act on the electric arc in such manner that part of the electric arc is stabilized near the axis of the device in the vicinity of the cathode.

Magnetic field located before the region where the cathode narrows by curving, resp. its axial part, has an orientation opposite to the axial part of the magnetic field in the diffuser.

Such distribution of the magnetic field allows to increase its force effect on the electric arc.

High magnetic field intensity in the spark gap protects the spark gap area by spinning intensely and pushing the electric arc out of the spark gap and protecting it against melting.

It is preferred that the magnetic field acts on the electric arc in such manner that the arc root on the electrodes moves in a circular path.

The concurrent actions of the magnetic field and the hydrodynamic forces on the electric arc has to be such that the direction of the resulting force points towards the material to be disrupted and this resulting force presses the formed electric arc into close proximity of the material to be disrupted.

Similarly, forces induced by action of magnetic and/or electromagnetic field act on the electric arc with tangential and axial pressing component simultaneously.

The electric arc can be moved along the surface shaped as a circular ring, wherein circular ring's symmetry axis is identical to the symmetry axis of the whole device.

A power pulse can be fed into the electric arc in working mode and working in gaseous or aqueous medium to generate pressure shock wave.

Electric arc prior to the introduction of power pulse can be induced into contraction to amplify the pressure shock wave.

In order to increase the efficiency of the device, it is preferred that radiation component of the electric arc's heat flow directed into the device is reflected by reflecting surfaces towards the material to be disrupted, that is in the direction in which the electric arc is transferred.

Following the passage of the pressure shock wave initiated by the electro-hydraulic phenomenon, a reduction in density of the working medium occurs in the vicinity of the electric arc, original density of working medium is subsequently restored by further input of the working medium.

It is preferred that by the concurrent action of the magnetic field and the hydrodynamic forces the part of electric arc that is situated near the cathode is stabilized in such way that the axis of symmetry of the part of the electric arc is parallel to the axis of the device, so as to widen to maximum the active, spiral part of the electric arc.

It is preferred that by the concurrent action of the magnetic field and hydrodynamic forces the root of the arc near the anode is pushed to the outer edge of the anode, so as to widen to the greatest possible extent the active part of the electric arc.

An electric arc shaped as a spiral rotating under the influence of magnetic field and hydrodynamic forces acts by centrifugal forces on the material located in the space between the device and material to be disrupted, and thus material is removed from this area. Cooling medium supplied to the surface of electrodes protects the parts of electrodes exposed to heat.

It is preferred that cathode's own magnetic field force action amplifies force effect of magnetic field on the electric arc.

Increasing the magnetic field intensity can be achieved by increasing the speed of rotation of the electric arc spiral, which will increase the centrifugal forces and action on the material in the space defined by the spiral motion.

The primary attributes of generator used to generate the electric arc acting areally on the treated material:

1. Producing electric arc with temperatures of several thousand degrees Celsius directly areally acts by the heat flow on conductive and non-conductive materials. The need for the presence of transport medium for heat flow (as for example in plasma torch) is minimized, since the distance between the electric arc and material to be disrupted is minimal. This increases the heat transfer efficiency in process of interaction with the material and it is limited to a thin region of millimeter dimensions. An electric arc cannot burn without plasma medium, but intense heat flow at minimum flow rate of the plasma medium is caused by minimizing the distance between the electric arc and the material, that is by proximity and action of electric arc on material to be disrupted.

2. Movement of the electric arc is controlled and subject to
   a. magnetic field generated by permanent magnets,
   b. magnetic field generated by electromagnets, which influence shock rate and the impulse,
   c. force action of flowing working and plasma medium.
3. The heat flow generated by moving and rotating the spiral transfers the heat into material to be disrupted on the whole surface outside the diffuser, in electric arc's active part where the process of disintegration occurs. Distribution of the heat flow is nearly homogeneous.
4. Compared to conventional plasma generators the present invention device allows for the use of electro-hydraulic phenomenon, that is to generate pressure shock waves in gaseous and liquid environments and use resulting mechanical forces to disrupt and transport fragmented rock outside the space between the arc and the material to be disrupted.
5. The rotating spiral of an electric arc in the device for generating an electric arc acts in addition to thermal action also as a pump, removing through centrifugal forces disrupted material; wherein increasing the magnetic field intensity (e.g. with cumulative pulse) increases dramatically its removal rate.
6. The device for generating an electric arc allows in a pressure wave generation and magnetic field pulse increase mode to use power current pulses generation with a time transformation charge/discharge ranging from 4 to 7 orders of magnitude (sec/μsec), thus allowing to increase the instantaneous disrupting pulse power output or electromagnetic field up to MW, respectively even GW.
7. In the device for generating an electric arc, the electric arc is scanned over the surface of the electrodes and the roots move by means of the magnetic field, through the vortex. The arc is not fixed with root to the device body, by which reducing wear and prolonging life of device is achieved. The device life is also increased by dividing it into hot and cold parts by rigorous pushing out of hot processes outside the device and manufacturing the electrode surfaces from the material that reflects the radiative heat flows towards the material to be disrupted.
8. The system allows to obtain electrical and/or optical characteristics of the electric arc in interaction with the material to be disrupted, which is advantageous for the indirect derivation of sensory information (e.g. the device distance from the bottom of the borehole, online spectroscopy, etc.).
9. The system in an electric arc generation mode allows, similarly to the interaction of the rotating spiral body and viscous fluids, analogy of pumping and pushing out the flowing medium and material to be disrupted through pressure gradient generated by the electric arc. Moving spiral electric arc removes and pushes out the disrupted material by centrifugal forces, wherein increasing the magnetic field intensity (e.g. by cumulative pulse) increases dramatically its rate of removal.

The system allows to use pressure shock waves and pumping caused by rotating spiral of the electric arc to transport rocks away from the place of disintegration. This eliminates removal of rocks by means of water jet (hydromagmatic phenomenon), which cools down and slows the drilling process.

Transferring the major part an electric arc outside the electric arc generating device's space substantially reduces demands on thermal resistance of the used construction materials and the device space stays cooler, which increases longevity of the device.

The device for generating an electric arc contains the following essential elements: axially symmetrical electrodes, that is an anode and an cathode, a spark gap, nozzles for the working medium flow, cooling media inlet and outlet, electric power supply, ring-shaped magnets whose section has the shape of a triangle and the anode has the shape of the diffuser with an angular span from 5° into 130°.

The anode in the shape of the diffuser performs the following purposes: The arc root uniformly moves along the inner side of the anode ensuring so even thermal load on the significant part of the electrode. Radii of the electrodes' curvature are not less than 2 mm in order to maintain the correct geometry of lines of force of electric field and limit local electric field amplification. The shape of the anode also enables effective interaction of the arc column with the fluid medium flow. The electrode surface also reflects the radiative heat flow directed into the device back into the area with material to be disrupted.

The cathode may for example be in the shape of a truncated cone. This electrode is used for arc discharge. The distinctive shape of the electrode ensures the stabilization of arc discharge's root in such manner that close to the electrode flow causes a negative pressure, which stabilizes arc's root in the area of reduced pressure.

Ring-shaped magnets with triangular cross-section ensure with their distinctive shape presence of magnetic field needed to rotate the arc discharge roots and at the same time causing movement in the axial direction.

Nozzles for the flow of working medium have two main functions: the interaction of the flow of working medium with the arc intensifies motion effects caused by the magnetic field acting on the arc discharge (an increase in the speed of rotation and more intense movement in the axial direction). They supply the necessary amount of plasma medium into the arc channel.

A spark gap is used to initialize the electrical discharge and is positioned as shown in FIG. 1, 2. Electric discharge is immediately after its formation pushed out by the fluid flow against the action of the local magnetic field into the device's working area. The spark gap also serves as the nozzle for plasma medium entry.

Diffuser is bounded by the anode itself and the treated rock, to which at least a part of the electric arc is approaching. The primary function of the diffuser is to homogenize the temperature field on the boundary between the device and the treated rock.

The device for generating an electric arc further contains electromagnets designed to create time-variable component of the magnetic field.

Furthermore, the device may contain functional elements providing protection to exposed body parts of the generator, especially electrodes, from thermal overload. Surface of the electrodes is made of porous ceramics which by coolant supply performs protective function by creating a protective water film on the surface of the electrodes. Electrode surface also contains shape and design features that create reflective surfaces of the electrodes that reflect and direct the heat flow towards the material to be disrupted. It is preferred that at least a part of the anode and/or cathode is covered with a layer of reflective material. Because of the heat resistance and directed thermal conductivity when cooling the electrodes, the electrodes are made of composite materials (Cu—W, etc.), which is advantageous in terms of their service life.

The main advantages of the present invention over prior art: the effective concentration of the heat flow and its direct areal action towards the rock. In the areas of intense disintegration the heat flows are directed towards the rock. This makes possible to obtain a heat process of high efficiency, in which with increasing pressure the thermal conductivity also increases, and thereby the heat flow into the rock is increased.

OVERVIEW OF FIGURES IN DRAWINGS

The nature of invention is further clarified in examples of its embodiment which are disclosed in the on the basis of attached drawing, which show:

EXAMPLES OF THE INVENTION EMBODIMENTS

Example 1

Figure 1:
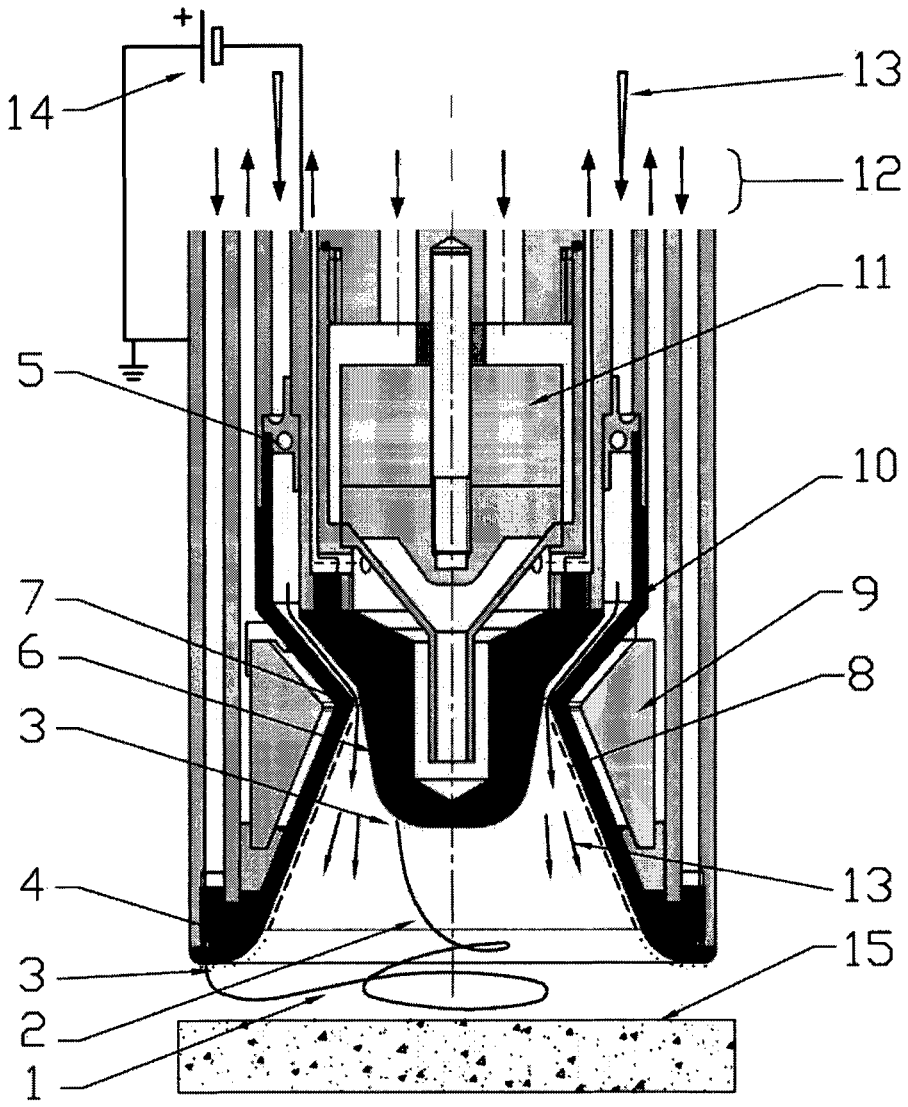
FIG. 1 shows a sectional view of the device for generating an electric arc.

Example of embodiment is shown in FIG. 1 Electric discharge is initiated in the spark gap 7, with the ignition voltage on the power supply 14 ranging from 0 to 10 kV. A spark gap 7 is positioned so that it is possible by means of working medium 13 to overcome the magnetic forces and push out the discharge 1, 2 into the device diffuser chamber. Electric arc 1, 2: consisting of the spiral active part 1 and an axial part 2, is stabilized in the device diffuser by two dominant forces. Lorentz force, due to presence of magnetic field generated by the permanent magnets 9, 11. The size and direction of the magnetic field generated by permanent magnets causes movement of the arc in tangential direction, while also stabilizing electric arc roots 3 on the edge of the anode 4 as well as the cathode 6. Force induced by the fluid flow 13 amplifies the tangential movement that induced by Lorentz force, but mainly causes movement of the electric arc 1, 2 in an axial direction. Geometry of the cathode 6 is designed such that the fluid flow 13 consisting of the working medium causes reduction in pressure at the edge of the cathode 6, whereby like the magnetic field it stabilizes the root 3 of the electric arc 1, 2, which is thus moving in a circle at the edge of the cathode 6. Axial part of the electric arc 2 is stabilized near the axis of the device in the vicinity of the cathode 6. The anode geometry 4 allows the flowing medium to achieve relatively high speeds near the surface 10 of the anode 4. By interaction of the flowing medium and the electric arc 1 the arc discharge is pushed out to the edge of the anode 4 towards the treated material 15. The root 3 of the electric arc moves in a circle along the extended part of the anode 4.

Stabilized electric arc 1, shaped as a spiral, rotates in close proximity to the material to be disrupted 15. But the heat transfers from the electric arc into components of the device are because of significantly larger distances smaller on the order of magnitude than the heat transfers into the material to be disrupted. The arc spiral 1 works at the same time as a centrifugal pump and removes the evaporated and melted fragments of the disrupted rock in the radial direction out of the device working area. The entire device is cooled with a layered structure of the anode 4 and the cathode 6 and the device casing with parallel supply of cooling media 12. Plasma medium 13 is supplied centrally into the spark gap 7 using nozzles 5.

Example 2

Figure 2:
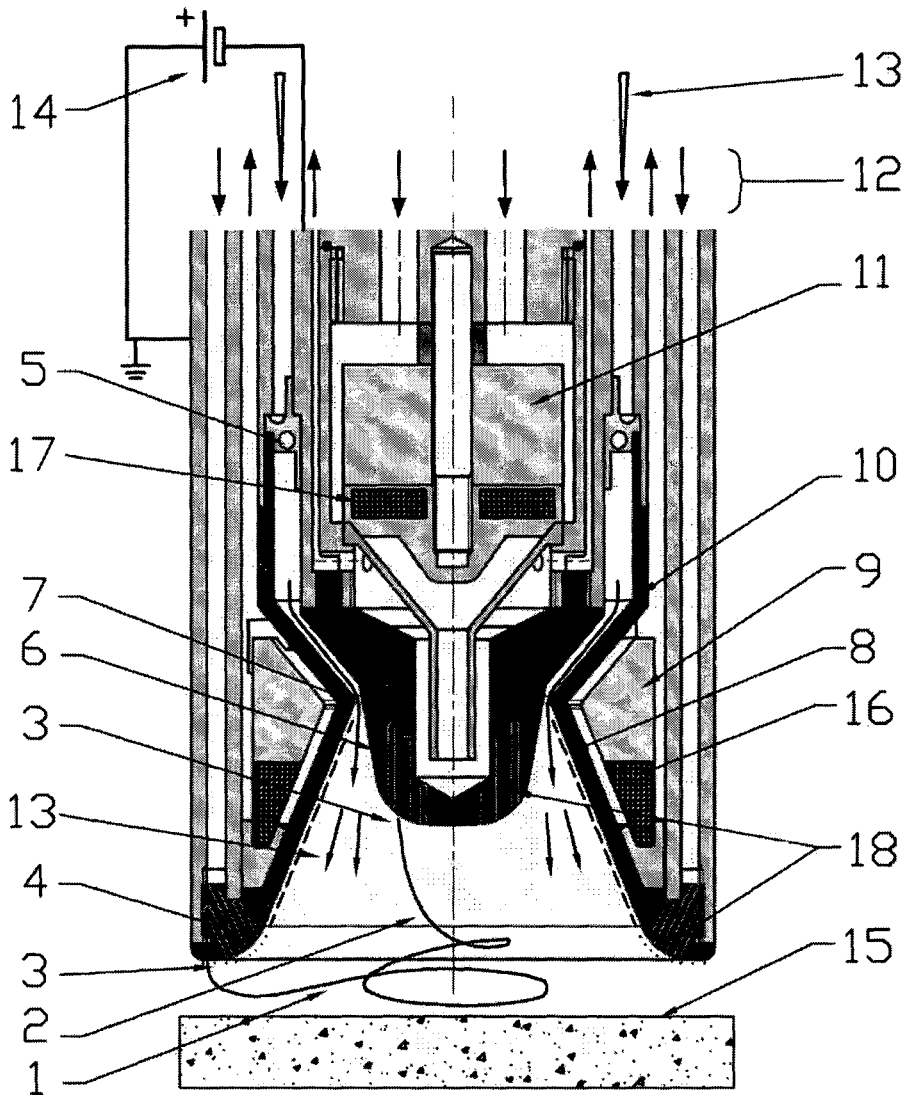
FIG. 2 shows a sectional view of the device for generating an electric arc with combination of magnets and electromagnets.
Figure 3:
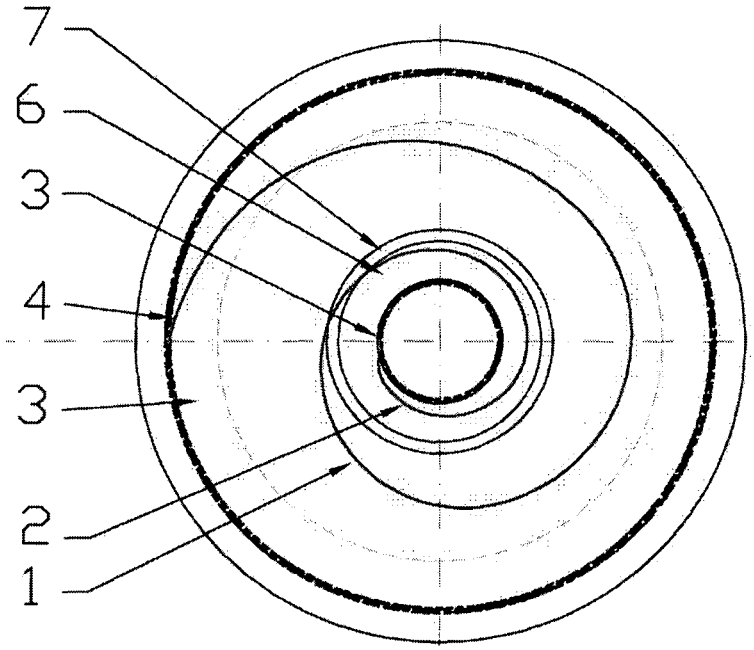
FIG. 3 shows a front view of the device for generating an electric arc.

This example realization is shown in. FIG. 2. An electric discharge is initiated in a spark gap 7, with the ignition voltage on the power supply 14 ranging from 0 to 10 kV. The spark gap 7 is positioned so that it is possible by means of working medium 13 to overcome the magnetic forces and push out the electric arc 1, 2 into the device diffuser chamber. Both parts of the electric arc 1, 2, are stabilized in the device diffuser by two dominant forces. The Lorentz force, induced by the presence of a magnetic field generated by permanent magnets 9, 11 and electromagnets 16, 17. The size and direction of the magnetic field generated by the permanent magnets causes movement of the arc in tangential direction, while stabilizing the electric arc roots 3 on the edge of the anode 4 as well as the cathode 6. Force induced by the fluid flow 13 amplifies the tangential movement induced by the Lorentz force, but mainly moves the electric arc 2 in an axial direction. The geometry of the cathode 6 is designed such that the fluid flow of the working medium 13 causes a reduction in pressure at the edge of the cathode 6, whereby like the magnetic field it stabilizes the electric arc root 3, which thus moves in a circle at the edge of cathode 6. The anode 4 geometry allows the flowing medium to achieve relatively high speeds near the surface 10 of the anode 4. By interaction between the flowing medium and the conductive channel the electric arc 1 is pushed out to the edge of the anode 4 towards the treated material 15. The electric arc's root 3 moves in a circle along the widened part of the anode 4.

The arc 1, 2 can be moved in an axial direction by action of the magnetic field generated by electromagnets 16, 17. Components of the magnetic field generated by electromagnets 16, 17 are not constant over time and the fed in power pulses allow relatively rapid changes in direction and size of the total magnetic field intensity. Disclosed changes in the magnetic field cause rapid changes in the movement of the electric arc 2 and thus contribute to the formation of pressure shock wave through electro-hydraulic phenomenon and thereby contribute to the process of disintegration and removal of disrupted rock outside the device space. To enhance the action, the electric arc is brought into contraction prior to the introduction of power pulse. The passage of pressure shock wave initiated by electro-hydraulic phenomenon causes in the vicinity of electric arc reduction in density of the working medium, but its presence at the original density is then renewed by feeding in the new working medium 13.

Stabilized electric arc 1, shaped as a spiral, rotates in close proximity to the material to be disrupted 15. But the heat transfers from the electric arc into components of the device are because of the significantly larger distances smaller on the order of magnitude than the heat transfers into the material to be disrupted. The arc spiral 1 works at the same time as a centrifugal pump and removes the evaporated and melted fragments of the disrupted rock in the radial direction from the device working area. The entire device is cooled with a layered structure with parallel power supply 12. Plasma medium 13 is supplied centrally using nozzles 5.

Both electrodes of the generator: the anode 4 and the cathode 6 are made of porous ceramics which performs a protective function by supplying coolant supply and creating protective water film on the surface of the electrodes 8.

Electrode surface also contains shape and design features that create reflective surfaces that reflect and direct the heat flow towards material to be disrupted 15. The anode 4 and the cathode 6 are at the edges where the root 3 of the electric arc 1, 2 moves and is stabilized, and the electrodes are made of a Cu—W composite for better heat resistance and directed thermal conductivity during their cooling, which helps to prolong their life.

THE LIST OF REFERENCE SIGNS

1. Spiral active part of the electric arc
2. Axial part of the electric arc
3. Roots of the electric arc
4. Anode/its composite part highlighted by dashed line/
5. Nozzles for the working medium
6. Cathode
7. Spark gap and input channel for the working medium
8. Protective and reflecting surface of the electrode
9. Permanent magnet of the anode
10. Inner distributing wall of the anode
11. Magnet of the cathode
12. Coolant inputs and outputs
13. Working plasma medium/steam/
14. Power supply for an device generating electric arc
15. Material to be disrupted/treated material
16. Electromagnet of the anode
17. Electromagnet of the cathode
18. Composite (Cu—W)

The invention claimed is:

1. A method comprising:

generating electric arc with thermal and mechanic action on a material, being formed between electrodes of a generating device in a spark gap characterized in that the electrical arc is shaped and guided by an action of a magnetic field, composed of an external magnetic field and of an electric field of the electric arc, and hydro-mechanical forces, which are created by an interaction of a smoothly expanding working medium with the electric arc, on the electrical arc generated between the electrodes forming an axially symmetrical electrode assembly, in such manner that:

a substantial part of the electric arc acts directly and areally on conductive material, non-conductive material, or a combination thereof to be disrupted, a substantial part of a heat flow from the electric arc is directed into the conductive material or the non-conductive material to be disrupted, at least part of the electric arc is formed into a shape of a spiral, wherein a pair of electric arc roots are moved on the electrodes of the generating device.

2. The method according to claim 1 characterized in that the electrical arc is shaped and guided in such manner that, by interaction of the magnetic field and the hydro-mechanical forces, a substantial part of the electric arc is moved and is directed and pushed outside the space of the generating device towards a rock to be disrupted.

3. The method according to claim 1 characterized in that at least one of the electrodes having the shape of the diffuser provides an increase of an area through which the working medium flows and thus a heat-exposed surface of the electrodes on which roots of the electric arc move is increased.

4. The method according to claim 1 characterized in that the magnetic field and the hydro-mechanical forces are set by their characteristic parameters in such a manner that a part of the electric arc is stabilized near an axis of the device in the vicinity of a cathode.

5. The method according to claim 1 characterized in that distribution and orientation of the magnetic field allows an increased effect of force action on the electric arc in a narrowed part of at least one of the electrodes by the magnetic field located before a region where a cathode narrows by curving or an axial part of the magnetic field has an orientation opposite to orientation of an axial part of the magnetic field in the diffuser.

6. The method according to claim 1 characterized in that increased level of intensity of the magnetic field in interaction with the hydro-mechanical forces generates intensive force action in the spark gap (7) and thereby the electric arc is spun and pushed out of the spark gap (7) and thus the spark gap (7) is protected against melting.

7. The method according to claim 1 characterized in that the magnetic field acts on the electric arc in such manner that an arc root on the electrodes moves in a circular path.

8. The method according to claim 1 characterized in that part of the electric arc shaped as a spiral rotates in a discoid space and can be moved in axial direction.

9. The method according to claim 1 characterized in that the electric arc is moved along a surface shaped as a circular ring comprising a first symmetry axis, wherein the device comprises a second symmetry axis, wherein the first symmetry axis is identical to the second symmetry axis.

10. The method according to claim 1 characterized in that a power pulse is fed into the electric arc in operation mode working in a gaseous medium or an aqueous medium to generate a pressure shock wave, wherein the electric arc is induced into contraction prior to the introduction of power pulse.

11. The method according to claim 1 characterized in that a radiation component of the heat flow directed into the device is reflected from reflection surfaces with high degree of reflection and heat resistance and thereby increases energy flow towards the conductive material or non-conductive material to be disrupted, in the direction in which the electric arc is transferred.

12. The method according to claim 1 characterized in that following passage of a pressure shock wave initiated by an electro-hydraulic phenomenon, a reduction in density of the working medium occurs in the vicinity of the electric arc, wherein working medium comprises an original density, wherein the original density is subsequently restored by further input of the working medium.

13. The method according to claim 1 characterized in that characteristic parameters of the magnetic field and the hydro-mechanical forces are set in such a manner that, by their interaction with the electric arc, a part of the electric arc situated near a cathode is stabilized in such a manner that an axis of symmetry of the part of the electric arc is parallel to an axis of the device, so as to widen an active, spiral part of the electric arc over a surface of the material to be disrupted.

14. The method according to claim 1 characterized in that concurrent action of the magnetic field and hydro-mechanical forces a root of the electric arc near an anode to an outer edge of the anode so as to widen an active part of the electric arc.

15. The method according to claim 1 characterized in that the electric arc shaped as a spiral rotating under the influence of the magnetic field and the hydro-mechanical forces acts by centrifugal forces also on a disrupted material located in the space between the device and the material to be disrupted, and thus the disrupted material is removed from this area.

16. The method according to claim 1 characterized in that a cooling medium is supplied to a surface of the electrodes to protect the electrodes from heat.

17. The method according to claim 1 characterized in that the magnetic field is amplified by a magnet situated on a cathode.

18. The method according to claim 15 wherein the spiral of the electric arc exhibits a speed of rotation, further comprising increasing the magnetic field intensity to thereby increase the speed of rotation and the centrifugal forces on the disrupted material.

* * * * *